US010832649B2

(12) United States Patent
Bastyr

(10) Patent No.: US 10,832,649 B2
(45) Date of Patent: Nov. 10, 2020

(54) ADAPTATION ENHANCEMENT FOR A ROAD NOISE CANCELLATION SYSTEM

(71) Applicant: Harman International Industries, Incorporated, Stamford, CT (US)

(72) Inventor: Kevin J. Bastyr, Franklin, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/776,032

(22) Filed: Jan. 29, 2020

(65) Prior Publication Data

US 2020/0175956 A1 Jun. 4, 2020

Related U.S. Application Data

(63) Continuation of application No. 16/205,895, filed on Nov. 30, 2018, now Pat. No. 10,580,399.

(51) Int. Cl.
*G10K 11/178* (2006.01)

(52) U.S. Cl.
CPC .. *G10K 11/17823* (2018.01); *G10K 11/17825* (2018.01); *G10K 11/17881* (2018.01); *G10K 2210/12821* (2013.01); *G10K 2210/3027* (2013.01); *G10K 2210/3044* (2013.01)

(58) Field of Classification Search
CPC ..... G10K 11/17823; G10K 11/17825; G10K 11/17881; G10K 2210/12821; G10K 2210/3027; G10K 2210/3044
See application file for complete search history.

(56) References Cited

U.S. PATENT DOCUMENTS

| | | | | |
|---|---|---|---|---|
| 10,332,504 | B1 | 6/2019 | Bastyr | |
| 10,580,399 | B1 * | 3/2020 | Bastyr | G10K 11/17881 |
| 2005/0053244 | A1 | 3/2005 | Onishi et al. | |
| 2010/0014685 | A1 | 1/2010 | Wurm | |
| 2011/0261970 | A1 | 10/2011 | Hamelink et al. | |
| 2013/0259249 | A1 | 10/2013 | Sakamoto et al. | |
| 2015/0228267 | A1 | 8/2015 | Inoue | |
| 2015/0356966 | A1 | 12/2015 | Yano | |
| 2016/0012815 | A1 | 1/2016 | Yano | |
| 2016/0163304 | A1 | 6/2016 | Lee et al. | |
| 2017/0032806 | A1 | 2/2017 | Konjeti et al. | |
| 2018/0268803 | A1 | 9/2018 | Pfaffinger | |
| 2018/0286378 | A1 | 10/2018 | Shinno et al. | |

FOREIGN PATENT DOCUMENTS

| | | | |
|---|---|---|---|
| WO | 2017135013 | A1 | 8/2017 |

* cited by examiner

*Primary Examiner* — Andrew L Sniezek
(74) *Attorney, Agent, or Firm* — Brooks Kushman P.C.

(57) ABSTRACT

A road noise cancellation (RNC) system may include a signal analysis controller for detecting non-stationary, transient events based on sensor signals having a spectral or temporal character significantly different from steady-state road or cabin noise. Upon detection of such non-stationary events, the RNC system may modify the sensor signals to mask the non-stationary event, thereby preventing the RNC system's adaptive filters from mis-adapting because of transient, non-stationary events. Alternatively, the RNC system may pause or slow or pause adaptation of its controllable filters for the duration of a frame that includes the non-stationary event.

20 Claims, 4 Drawing Sheets

ADAPTATION ENHANCEMENT FOR A ROAD NOISE CANCELLATION SYSTEM

CROSS-REFERENCE TO RELATED APPLICATIONS

This application is a continuation of U.S. application Ser. No. 16/205,895, filed Nov. 30, 2018, the disclosure of which is hereby incorporated in its entirety by reference herein.

TECHNICAL FIELD

The present disclosure is directed to road noise cancellation and, more particularly, to detecting a non-stationary event in a feed-forward road noise cancellation system to minimize mis-adaptation.

BACKGROUND

Active Noise Control (ANC) systems attenuate undesired noise using feedforward and feedback structures to adaptively remove undesired noise within a listening environment, such as within a vehicle cabin. ANC systems generally cancel or reduce unwanted noise by generating cancellation sound waves to destructively interfere with the unwanted audible noise. Destructive interference results when noise and "anti-noise," which is largely identical in magnitude but opposite in phase to the noise, combine to reduce the sound pressure level (SPL) at a location. In a vehicle cabin listening environment, potential sources of undesired noise come from the engine, the interaction between the vehicle's tires and a road surface on which the vehicle is traveling, and/or sound radiated by the vibration of other parts of the vehicle. Therefore, unwanted noise varies with the speed, road conditions, and operating states of the vehicle.

A Road Noise Cancellation (RNC) system is a specific ANC system implemented on a vehicle in order to minimize undesirable road noise inside the vehicle cabin. RNC systems use vibration sensors to sense road induced vibrations generated from the tire and road interface that leads to unwanted audible road noise. This unwanted road noise inside the cabin is then cancelled, or reduced in level, by using speakers to generate sound waves that are ideally opposite in phase and identical in magnitude to the noise to be reduced at the typical location of one or more listeners' ears. Cancelling such road noise results in a more pleasurable ride for vehicle passengers, and it enables vehicle manufacturers to use lightweight materials, thereby decreasing energy consumption and reducing emissions.

RNC systems are typically Least Mean Square (LMS) adaptive feed-forward systems that continuously adapt W-filters based on both acceleration Inputs from the vibration sensors located in various positions around a vehicle's suspension system, subframe and body, and on signals of microphones located in various positions inside the vehicle's cabin. Certain driving events, such as driving over train tracks, hitting a pothole, and driving over a speedbump, induce signals in both the accelerometers and the microphones. Consequently, the LMS RNC system will adapt the W-filters to attempt to more optimally cancel these signals, which have a different spectral character than that of the surrounding pavement. However, these types of events are transients, and are not indicative of most of the road that the vehicle is traveling on. Therefore, when the W-filters are adapted based on these transient, non-stationary events, the RNC is worsened for a period of time after the events. This is because the RNC system needs to re-adapt to re-converge to the correct W-filters to optimally cancel the steady-state or pseudo-steady state road surface.

SUMMARY

Various aspects of the present disclosure relate to protecting a road noise cancellation (RNC) system from mis-adapting in response to non-stationary, transient events. Several detection and mitigation systems and/or methods are disclosed that prevent mis-adaptation of the RNC system's controllable filters.

In one or more illustrative embodiments, a method for preventing mis-adaptation in a feed-forward road noise cancellation (RNC) system is provided. The method may include adjusting an adaptive transfer characteristic based on a noise signal received from a vibration sensor, an error signal received from a microphone located in a cabin of a vehicle, and an adaptation parameter. The method may further include generating an anti-noise signal, to be radiated by a speaker as anti-noise within the cabin of the vehicle, based in part on the adaptive transfer characteristic. The method may further include receiving at least one sensor signal from at least one sensor and detecting a non-stationary event based on signal parameters sampled from a frame of the at least one sensor signal. The method may also include modifying the adaptation parameter for a duration of the frame in response to detecting the non-stationary event.

Implementations may include one or more of the following features. The sensor may be a vibration sensor or a microphone and the sensor signal may be a noise signal. The sensor may also be a microphone and the sensor signal may be an error signal. Detecting a non-stationary event based on signal parameters sampled from a frame of at least one sensor signal may include: comparing at least one signal parameter of a current frame for each sensor signal to a threshold; and detecting the non-stationary event when the at least one signal parameter exceeds the threshold. The signal parameter may be a peak amplitude of the sensor signal sampled in the frame. The signal parameter may be an energy value of each frame. The threshold may be a predetermined static threshold programmed for the RNC system. The threshold may be a dynamic threshold computed from a statistical analysis of the at least one signal parameter in one or more preceding frames of the sensor signal. Modifying an adaption parameter may include reducing a. rate of adaptation of one or more controllable filters. Modifying an adaption parameter may include pausing adaptation of one or more controllable filters by reducing a rate of adaptation of the controllable filters to zero. Modifying an adaption parameter may include deactivating the :RNC system for the duration of the frame.

One or more additional embodiments may be directed to an RNC system including a sensor adapted to generate a sensor signal on at least one output channel in response to an input. The RNC system may also include a controllable filter adapted to generate an anti-noise signal, the anti-noise signal to be radiated by a speaker as anti-noise within a cabin of a vehicle, based in part on an adaptive transfer characteristic. The RNC system may further includes an adaptive filter controller, including a processor and memory, programmed to control the adaptive transfer characteristic of the controllable filter based on a noise signal received from a vibration sensor, an error signal received from a microphone located in the cabin of the vehicle, and an adaptation parameter. The RNC system may further include a signal analysis controller, including a processor and memory, programmed to: detect a non-stationary event based on parameters sampled from a current frame of the sensor signal; and modify the adaptation parameter in response to detecting a non-stationary event. The adaptation parameter may determine a rate of change of the adaptive transfer characteristic, also called the step size, for the controllable filter.

Implementations may include one or more of the following features. The signal analysis controller may be programmed to modify the adaption parameter by reducing a rate of adaptation of the controllable filters. The sensor may be the vibration sensor or a pressure sensor and the sensor signal may be the noise signal. The sensor may be the microphone and the sensor signal may be the error signal. The signal analysis controller may be programmed to detect a non-stationary event based on parameters sampled from a current frame of the sensor signal by comparing at least one signal parameter of a current frame for each sensor signal to a threshold.

One or more additional embodiments may be directed to a computer-program product embodied in a non-transitory computer readable medium that is programmed for road noise cancellation (RNC). The computer-program product may include instructions for: receiving sensor signals from at least one sensor; detecting a non-stationary event based on signal parameters sampled from a frame of at least one sensor signal; and modifying an anti-noise signal to be radiated by a speaker as anti-noise within a cabin of a vehicle for the duration of the frame in response to detecting the non-stationary event.

Implementations may include one or more of the following features. The computer-program product where the instructions for detecting a non-stationary event based on signal parameters sampled from a frame of at least one sensor signal may include comparing at least one signal parameter of a current frame for each sensor signal to a threshold. The computer-program product where the instructions for modifying an anti-noise signal may include zeroing the frame of the sensor signal containing parameters indicative of the non-stationary event. The computer-program product where the instructions for modifying an anti-noise signal may include replacing the frame containing parameters indicative of the non-stationary event with a previous frame from the same sensor signal.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Any one or more of the controllers or devices described herein include computer executable instructions that may be compiled or interpreted from computer programs created using a variety of programming languages and/or technologies. In general, a processor (such as a microprocessor) receives instructions, for example from a memory, a computer-readable medium, or the like, and executes the instructions. A processing unit includes a non-transitory computer-readable storage medium capable of executing instructions of a software program. The computer readable storage medium may be, but is not limited to, an electronic storage device, a magnetic storage device, an optical storage device, an electromagnetic storage device, a semi-conductor storage device, or any suitable combination thereof.

Figure 1:
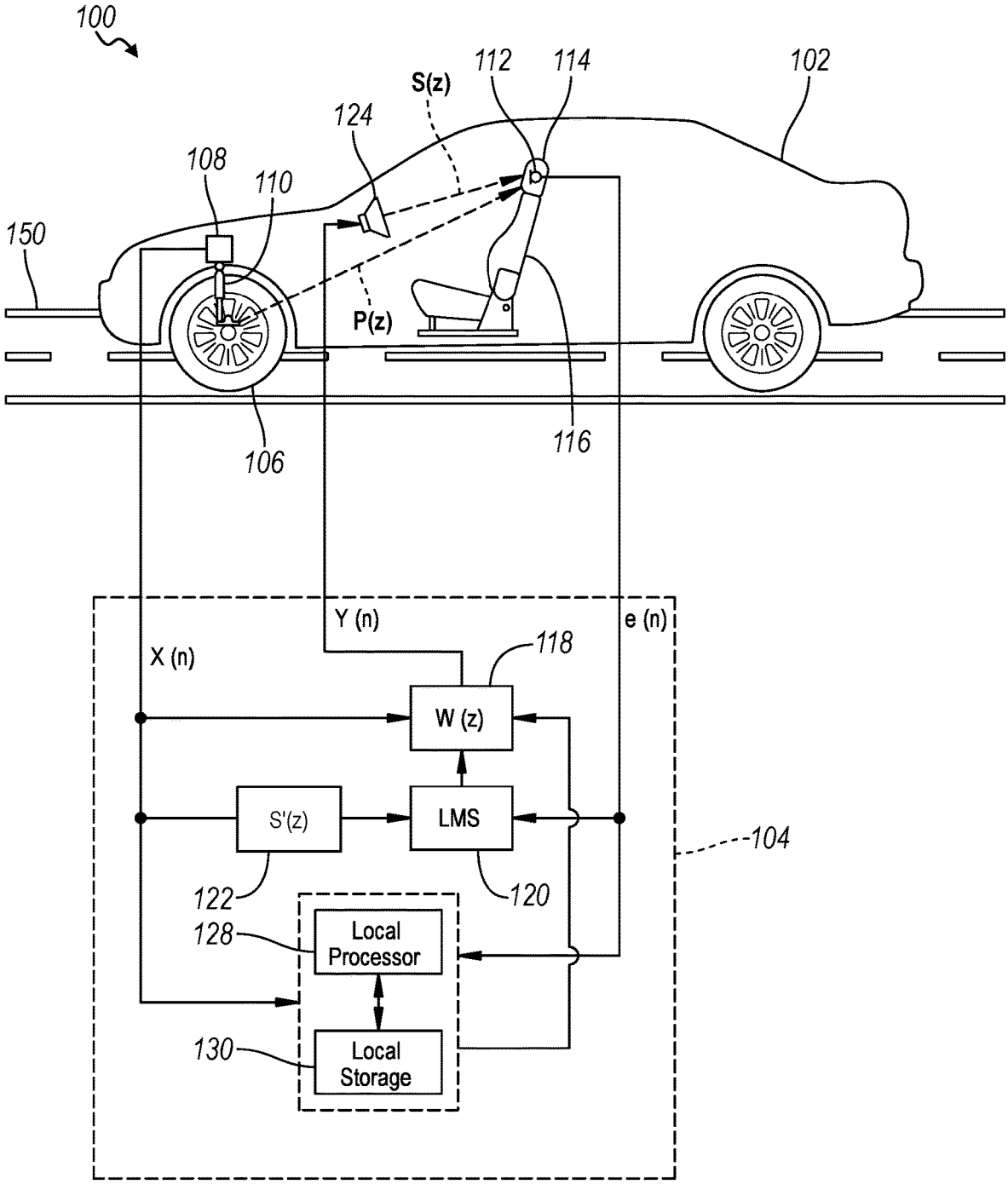
FIG. 1 is a block diagram of a vehicle having a road noise cancellation (RNC) system, in accordance with one or more embodiments of the present disclosure.

FIG. 1 shows a road noise cancellation (RNC) system 100 for a vehicle 102 having one or more vibration sensors 108. The vibration sensors are disposed throughout the vehicle 102 to monitor the vibratory behavior of the vehicle's suspension, subframe, as well as other axle and chassis components. The RNC system 100 may be integrated with a broadband feed-forward and feedback active noise control (ANC) framework or system 104 that generates anti-noise by adaptive filtering of the signals from the vibration sensors 108 using one or more microphones 112. The anti-noise signal may then be played through one or more speakers 124. S(z) represents a transfer function between a single speaker 124 and a single microphone 112. While FIG. 1 shows a single vibration sensor 108, microphone 112, and speaker 124 for simplicity purposes only, it should be noted that typical RNC systems use multiple vibration sensors 108 (e.g., 10 or more), speakers 124 (e.g., 4 to 8), and microphones 112 (e.g., 4 to 6).

The vibration sensors 108 may include, but are not limited to, accelerometers, force gauges, geophones, linear variable differential transformers, strain gauges, and load cells. Accelerometers, for example, are devices whose output voltage is proportional to acceleration. A wide variety of accelerometers are available for use in RNC systems. These include accelerometers that are sensitive to vibration in one, two and three typically orthogonal directions. These multi-axis accelerometers typically have a separate electrical output (or channel) for vibrations sensed in their X-direction, Y-direction and Z-direction. Single-axis and multi-axis accelerometers, therefore, may be used as vibration sensors 108 to detect the magnitude and phase of acceleration and may also be used to sense orientation, motion, and vibration.

Noise and vibrations that originate from a wheel 106 moving on a road surface 150 may be sensed by one or more of the vibration sensors 108 mechanically coupled to a suspension device 110 or a chassis component of the vehicle 102. The vibration sensor 108 may output a noise signal X(n), which is a vibration signal that represents the detected road-induced vibration. It should be noted that multiple vibration sensors are possible, and their signals may be used separately, or may be combined in various ways known by those skilled in the art. In certain embodiments, a microphone may be used in place of a vibration sensor to output the noise signal X(n) indicative of noise generated from the interaction of the wheel 106 and the road surface 150. The noise signal X(n) may be filtered with a modeled transfer characteristic S'(z), which estimates the secondary path (i.e., the transfer function between an anti-noise speaker 124 and an error microphone 112), by a secondary path filter 122.

Road noise that originates from interaction of the wheel 106 and the road surface 150 is also transferred, mechanically and/or acoustically, into the passenger cabin and is received by the one or more microphones 112 inside the vehicle 102. The one or more microphones 112 may, for example, be located in a headrest 114 of a seat 116 as shown in FIG. 1. Alternatively, the one or more microphones 112 may be located in a headliner of the vehicle 102, or in some other suitable location to sense the acoustic noise field heard by occupants inside the vehicle 102. The road noise originating from the interaction of the road surface 150 and the wheel 106 is transferred to the microphone 112 according to a transfer characteristic P(z), which represents the primary path (i.e,, the transfer function between an actual noise source and an error microphone).

The microphones 112 may output an error signal e(n) representing the noise present in the cabin of the vehicle 102 as detected by the microphones 112. In the RNC system 100, an adaptive transfer characteristic W(z) of a controllable filter 118 may be controlled by adaptive filter controller 120. The adaptive filter controller 120 may operate according to a known least mean square (LMS) algorithm based on the error signal e(n) and the noise signal X(n), which is optionally filtered with the modeled transfer characteristic S'(z) by the filter 122. The controllable filter 118 is often referred to as a W-filter. An anti-noise signal Y(n) may be generated by an adaptive filter formed by the controllable filter 118 and the adaptive filter controller 120 based on the identified transfer characteristic W(z) and the vibration signal, or a combination of vibration signals, X(n). The anti-noise signal Y(n) ideally has a waveform such that when played through the speaker 124, anti-noise is generated near the occupants' ears and the microphone 112 that is substantially opposite in phase and identical in magnitude to that of the road noise audible to the occupants of the vehicle cabin. The anti-noise from the speaker 124 may combine with road noise in the vehicle cabin near the microphone 112 resulting in a reduction of road noise-induced sound pressure levels (SPL) at this location.

While, the vehicle 102 is under operation, a processor 128 may collect and optionally processes the data from the vibrations sensors 108 and the microphones 112 to construct a database or map containing data and/or parameters to be used by the vehicle 102. The data collected may be stored locally at a storage 130, or in the cloud, for future use by the vehicle 102. Examples of the types of data related to the RNC system 100 that may be useful to store locally at storage 130 include, but are not limited to, frequency dependent leakage and step size, accelerometer or microphone spectra or time dependent signals, other acceleration characteristics including spectral and time dependent properties, and microphone-based acoustic performance data. In addition, the processor 128 may analyze the vibration sensor and microphone data and extract key features to determine a set of parameters to be applied to the RNC system 100. The set of parameters may be selected when triggered by an event. In one or more embodiments, the processor 128 and storage 130 may be integrated with one or more RNC system controllers, such as the adaptive filter controller 120.

As previously described, typical RNC systems may use several, vibration sensors, microphones and speakers to sense structure-borne vibratory behavior of a vehicle and generate anti-noise. The vibrations sensors may be multi-axis accelerometers having multiple output channels. For instance, triaxial accelerometers typically have a separate electrical output for vibrations sensed in their X-direction, Y-direction, and Z-direction. A typical configuration for an RNC system may have, for example, 6 error microphones, 6 speakers, and 12 channels of acceleration signals coming from 4 triaxial accelerometers or 6 dual-axis accelerometers. Therefore, the RNC system will also include multiple S'(z) filters (i.e., secondary path filters 122) and multiple W(z) filters (i.e., controllable filters 118).

The simplified RNC system schematic depicted in FIG. 1 shows one secondary path, represented by S(z), between each speaker 124 and each microphone 112. As previously mentioned, RNC systems typically have multiple speakers, microphones and vibration sensors, Accordingly, a 6-speaker, 6-microphone RNC system will have 36 total secondary paths (i.e., 6×6). Correspondingly, the 6-speaker, 6-microphone RNC system may likewise have 36 S'(z) filters (i.e., secondary path filters 122), which estimate the transfer function for each secondary path. As shown in FIG. 1, an RNC system will also have one W(z) filter (i.e., controllable filter 118) between each noise signal X(n) from a vibration sensor (i,e., accelerometer) 108 and each speaker 124. Accordingly, a 12-accelerometer signal, 6-speaker RNC system may have 72 W(z) filters. The relationship between the number of accelerometer signals, speakers, and W(z) filters is illustrated in FIG. 2.

Figure 2:
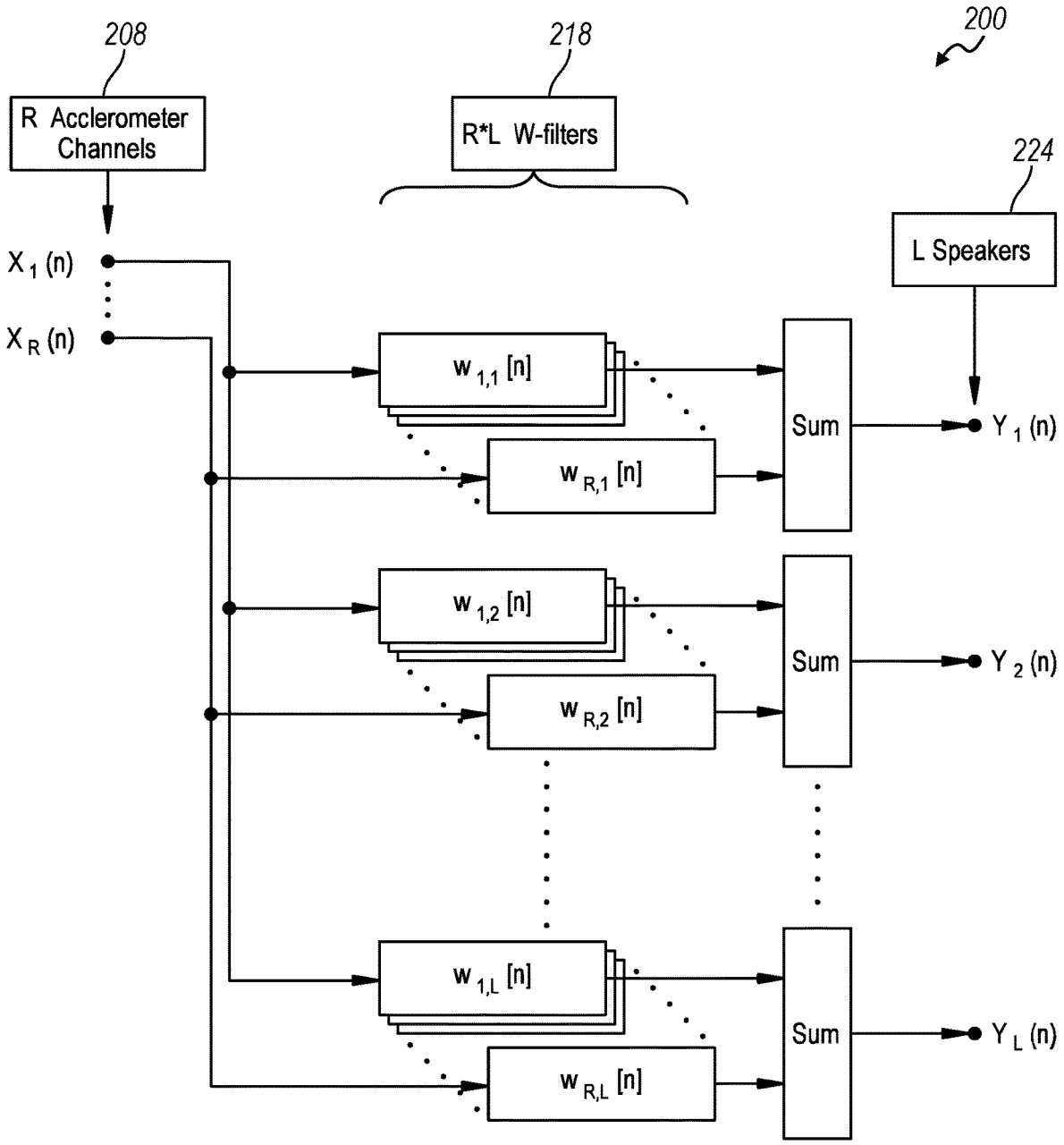
FIG. 2 is a sample schematic diagram demonstrating relevant portions of an RNC system scaled to include R accelerometer signals and L speaker signals.

FIG. 2 is a sample schematic diagram demonstrating relevant portions of an RNC system 200 scaled to include R accelerometer signals $[X_1(n), X_2(n), \ldots X_R(n)]$ from accelerometers 208 and L anti-noise speaker signals $[Y_1(n), Y_2(n), \ldots Y_L(n)]$ for speakers 224. Accordingly, the RNC system 200 may include R*L controllable filters (or W-filters) 218 between each of the accelerometer signals and each of the speakers. As an example, an RNC system having 12 accelerometer outputs (ie., R=12) may employ 6 dual-axis accelerometers or 4 triaxial accelerometers. In the same example, a vehicle having 6 speakers (i.e., L=6) for reproducing anti-noise, therefore, may use 72 W-filters total. At each of the L speakers, R W-filter outputs are summed to produce the speaker's anti-noise signal Y(n). Each of the L speakers may include an amplifier (not shown). In one or more embodiments, the R accelerometer signals filtered by the R W-filters; are summed to create an electrical anti-noise signal y(n), which is fed to the amplifier to generate an amplified anti-noise signal Y(n) that is sent to a speaker.

As set forth above, RNC systems are susceptible to mis-adaptation due to non-stationary events, such as driving over train tracks, hitting a pothole, driving over a speed-bump or a crack or patch in the road. If the LMS system adapts the W-filters based on non-stationary signals, the RNC performance may be degraded in the time period immediately afterward because these non-stationary signals are transient in nature, and have a different spectral character than that of the steady-state road surface. Adaptation of the LMS system with non-stationary inputs is described as mis-adaptation, due to the degraded noise cancellation performance that can result following the non-stationary input. Mis-adaptation of the W-filters in response to non-stationary, transient events may be prevented by detecting such events and mitigating their effect on the LMS adaptation algorithm.

To detect a non-stationary event, such as driving over train tracks or hitting a pothole, the noise signal(s) X(n) output from one or multiple accelerometers in the RNC system may be evaluated. The noise signal X(n) of each accelerometer channel may be an analog or digital signal.

Evaluation of the time history of these output signals may identify non-stationary, transient events when they occur. For instance, driving over a pothole may cause a relatively high amplitude, short duration pulse to appear on an accelerometer output. It is likely that this high amplitude (i.e., possibly full-scale), short-duration signal will appear on more than one of the X-, Y-, and Z-direction output channels of more than one accelerometer, perhaps during different frames.

Figure 3A:
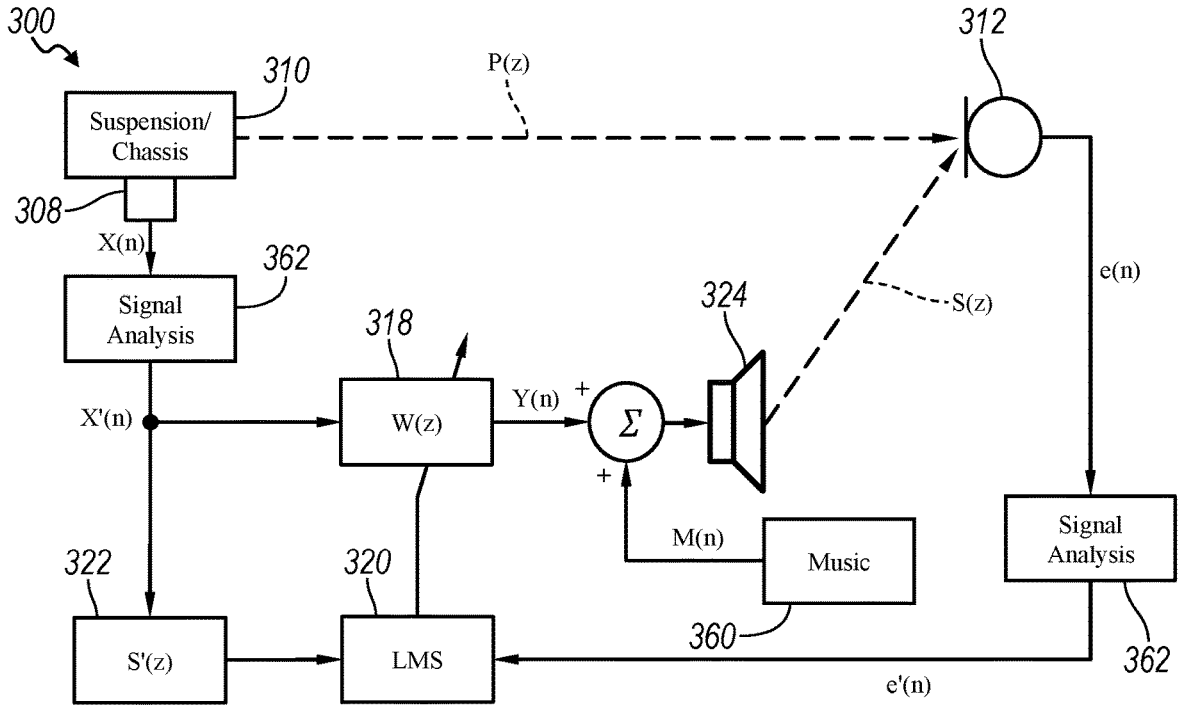
FIG. 3*a* is a schematic block diagram representing an RNC system including a signal analysis controller, in accordance with one or more embodiments of the present disclosure.
Figure 3B:
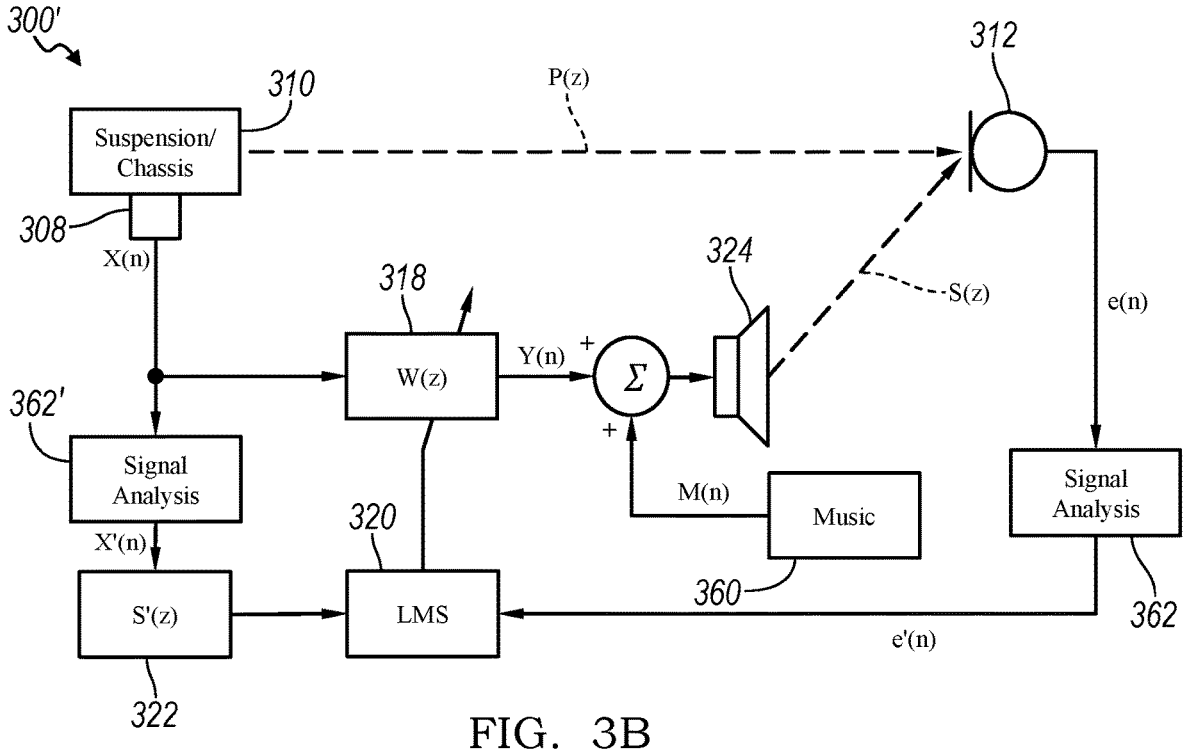
FIG. 3*b* is a schematic block diagram representing an alternative RNC system including a signal analysis controller.

FIG. 3*a* is a schematic block diagram representing an RNC system 300, in accordance with one or more embodiments of the present disclosure. The RNC system 300 may be a Filtered-X Least Mean Squares (FX-LMS) RNC system, as understood by those of ordinary skill in the art. Similar to RNC system 100, the RNC system 300 may include elements 308, 310, 312, 318, 320, 322, and 324, consistent with operation of elements 108, 110, 112, 118, 120, 122, and 124, respectively, discussed above. In one or more embodiments, a music signal M(n) from a music playback device 360, such as the head unit (not shown) may be combined with the anti-noise signal Y(n) to be amplified and sent to the speaker 324. FIG. 3 also shows the primary path P(z) and secondary path S(z), as described with respect to FIG. 1, in block form. As shown, the RNC system 300 may further include one or more signal analysis controllers 362. Each signal analysis controller 362 may include a processor and memory (not shown), such as processor 128 and storage 130, programmed to detect non-stationary events, including impulsive events that are contained within the time dependent noise signal X(n) and/or the error signal e(n). This may include computing parameters by analyzing time samples from a frame of the noise signal X(n). Accordingly, the signal analysis controller 362 may be disposed along the path between the vibration sensor 308 and the adaptive filter (i.e., the controllable filter 318 and the adaptive filter controller 320). In an alternate embodiment shown in FIG. 3*b*, a signal analysis controller 362' may be disposed along the path between the vibration sensor 308 and the adaptive filter controller 320, not acting on the signal into the controllable filter 318. In other embodiments, a signal analysis controller 362 may be disposed along the path between the microphones 312 and the adaptive filter controller 320. The signal analysis controller 362 may be a dedicated controller for detecting non-stationary signals or may be integrated with another controller or processor in the RNC system, such as the LMS adaptive filter controller 320. Alternatively, the signal analysis controller 362 may be integrated into another controller or processor within vehicle 102 that is separate from the other components in the RNC system.

In response to detecting a non-stationary event, the RNC system 300 may slow adaptation of some or all of the controllable filters 318, or pause adaptation altogether, for the duration of the frame in which the event is detected. The LMS algorithm's step size controls the rate of adaptation. A smaller step-size slows the adaptation of the controllable filters 318 based on the acceleration and microphone inputs. Reducing the step size for the duration of a frame results in the controllable filters 318 changing less than they otherwise would due to the presence of these nonstationary inputs. Reducing the step-size to zero effectively pauses the adaption, by preventing adaptation of the controllable filters 318 based on these nonstationary signals for the duration of the frame. Other, equivalent methods to pause adaptation for the duration of the frame may be employed, such as a repetition of the previous frame's controllable filter(s) 318 rather than updating the controllable filter(s) based on an input frame containing a non-stationary event.

Alternatively, the signal analysis controller 362 may generate an adjusted noise signal X'(n) or adjusted error signal e'(n) in response to detecting a non-stationary event, as depicted in FIG. 3. Accordingly, the controllable filter 318 may be configured to generate the anti-noise signal Y(n) based on the adjusted noise signal X'(n) and the adaptive transfer characteristic W(z) as controlled by the LMS adaptive filter controller 320. The adjusted noise signal X'(n) may modify the anti-noise signal Y(n) to be radiated by the speaker 324 as anti-noise in a manner that reduces the effect of the non-stationary event on the anti-noise. The adjusted error signal e'(n) and/or noise signal X'(n) may also prevent the controllable filter 318 from mis-adapting due to a non-stationary or transient event. If a non-stationary event is not detected, the signal analysis controller 362 may not adjust the noise signal X(n) and/or error signal e'(n) such that the noise signal X(n) and/or error signal e(n) may be passed through to the controllable filter 318, and/or LMS block 320.

Figure 4:
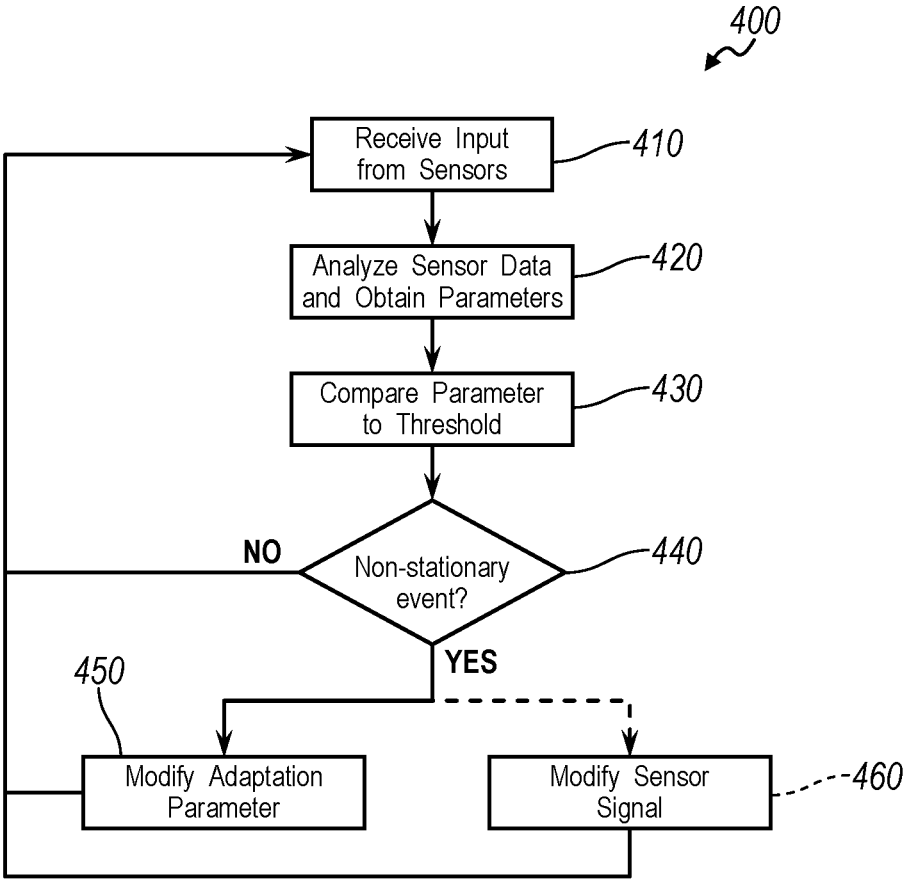
FIG. 4 is a flowchart depicting a method for preventing mis-adaptation of controllable filters in an RNC system due to non-stationary events, in accordance with one or more embodiments of the present disclosure.

FIG. 4 is a flowchart depicting a method 400 for preventing mis-adaptation of controllable filters in an RNC system due to non-stationary events. Various steps of the disclosed method may be carried out by the signal analysis controller 362, either alone, or in conjunction with other components of the RNC system. Moreover, certain descriptions of the method may be explained in connection with detecting a non-stationary event based on the noise signal from a vibration sensor 308. However, non-stationary events may be detected by a similar signal analysis applied to error signals e(n) received from a microphone 312, such as what may occur when a passenger rubs or strikes a microphone or during speech inside the passenger cabin or due to wind or other incident airflow. In certain embodiments, non-stationary events included in the noise signal X(n) originating from microphones or other sensor types than accelerometers may be detected by the signal analysis controller 362.

At step 410, the RNC system 300 may receive sensor signals, such as noise signals X(n) from at least one vibration sensor 308 and/or error signals e(n) from at least one microphone 312. The RNC system 300 may also receive sensor signals from other acoustic sensors in the passenger cabin, such as an acoustic energy sensor, an acoustic intensity sensor, or an acoustic particle velocity or acceleration sensor. To this end, a group of samples of time data from an output channel of a vibration sensor 308 or a microphone 312 may be received by the signal analysis controller 362. The group of samples of time data may form one digital signal processing (DSP) frame. In an embodiment, 128 time samples of the output from a sensor (i.e., vibration sensor 308 or microphone 312) may form a single DSP frame. In alternate embodiments, greater or fewer time samples may compose a single frame.

At step 420, an analysis of the sensor data within a frame may be performed. In various embodiments, this analysis may include calculating, extracting or otherwise obtaining one or more parameters from each frame of sensor data sampled from, for example, the noise signal X(n). In an example, the signal analysis controller 362 may calculate the fast Fourier transform (FFT) of the frame to form a frequency domain representation of the sensed vibrational input from the vibration sensor 308. The analysis may further include evaluating the FFT in one or multiple frequency ranges, or in individual frequency bins. For instance, non-stationary, transient events are typically a short duration impulse, which in the frequency domain is a very broadband signal. Thus, the acceleration character of many non-stationary events in the frequency domain is quite different than the acceleration character of the road in steady-state. Obtaining and analyzing a parameter from the frame such as a level of one or more frequency ranges may therefore enable detection of a non-stationary event. In other examples, the analysis could also include computing parameters such as the total energy within the DSP frame or the peak or highest amplitude of all the time samples within the frame. Because the amplitude of the acceleration signal created by a non-stationary event detected by a vibration sensor (such as an accelerometer) can be much higher amplitude than the acceleration signal created by traversing a predominant road surface, analyzing these parameters may also enable detection.

Step 420 may also include storing the parameter(s) or sensor data of a current frame for use in analyzing future frames of sensor data. In an embodiment, the parameter(s) or sensor data from the frame immediately prior to a current frame may be stored. In another embodiment, a statistical analysis may be performed on the parameters obtained from multiple prior frames of sensor data to determine a threshold. For instance, a short- or long-term average of a parameter obtained from multiple preceding frames may be calculated and stored as its own parameter for use in step 430, either as a threshold or to obtain a difference from the current frame for comparison to a threshold. In certain of these embodiments, a predetermined gain margin may be added to the average value (or other statistical value) calculated from multiple preceding frames to form a threshold. This may include adding a gain margin of 20%, 50% or 100% to the average value, or other statistical value. Thus, the average value from multiple preceding frames may be multiplied by a gain factor (e.g., 120%, 150%, 200%, etc.,) to obtain the threshold. In other embodiments, other gain factors are possible. In another embodiment, a threshold may be calculated using data from other sensors in the RNC system using any combination of the aforementioned threshold-deriving techniques. Additionally, a threshold may be derived by analyzing the current frame or a past frame or frames of sensor data from any, or combinations of any, noise signals from other vibration sensors.

At step 430, the parameter computed from the current frame of sensor data may be compared directly to a corresponding threshold. If the parameter from the current frame exceeds the threshold, the signal analysis controller 362 may conclude a non-stationary event has been detected. If the parameter from the current frame does not exceed the threshold, the signal analysis controller 362 may conclude that no nonstationary event has been detected. For instance, the signal analysis controller 362 may compute the energy in the current frame or a peak amplitude of the current frame and compare the energy value or peak amplitude to a corresponding threshold to determine whether a nonstationary event has occurred.

Alternatively, the parameter computed from the current frame of sensor data may be may be compared to a statistical value (e.g., average value) of the same parameter from one or more previous frames of sensor data obtained from either the same noise signal, one or more noise signals from other vibration sensors, or any combination thereof, as previously described. The difference between the current frame's parameter and the statistical value may then be compared to a threshold. If the difference exceeds the threshold, the signal analysis controller 362 may conclude a non-stationary event has been detected. If the difference does not exceed the threshold, the signal analysis controller 362 may conclude that a non-stationary event has not been detected. For example, in an embodiment, the signal analysis controller 362 may compute the energy in the current frame and compare it to the energy in a previous frame, noting that any difference exceeding a predetermined threshold may be indicative of a non-stationary signal, such as hitting a pothole. In another embodiment, the FFT of a current frame of the noise signal output front a vibration sensor may be calculated and compared to the FFT of the previous frame, noting that a change on the level of one or more FFT bins beyond a predetermined threshold may also be indicative of a non-stationary signal.

In one or more embodiments, the threshold may be a predetermined static threshold set and programmed by trained engineers during the tuning of the RNC system and its corresponding algorithms. In alternate embodiments, the threshold may be a dynamic threshold computed from a statistical analysis of the parameter obtained in one or more preceding frames as discussed above with regard to step 420. For instance, the threshold may be a short- or long-term average value of a parameter taken from multiple preceding frames. Moreover, the average value may be enhanced by a gain factor, as previously discussed, to establish the dynamic threshold. In yet another embodiment, the threshold may simply be the value of the parameter from the previous frame of time data, which may also be multiplied by a gain factor.

The signal analysis controller 362 may also apply temporal thresholding in conjunction with the aforementioned variants of amplitude thresholding at step 430. For example, some impulsive, non-stationary events induce a high amplitude output signal with a duration of 1 to 100 ms. Thus, temporal thresholding may further aid in the detection of nonstationary events. For instance, when the amplitude of samples in the current frame exceeds an amplitude threshold for less than a predetermined temporal threshold, an impulsive, non-stationary event may be detected.

Referring to step 440, when a non-stationary event is detected, the method may proceed to step 450 in which an adaptation parameter in the LMS algorithm is modified to prevent the RNC system from mis-adapting or diverging due to the non-stationary event. In an embodiment, the method may proceed to step 460 in which the sensor signal itself is modified in attempt to mask, reduce or eliminate the non-stationary event and prevent mis-adaptation. However, when a non-stationary event is not detected, the method may skip any adaptation parameter or signal modification and return to step 410 so the process can repeat with a new frame of sensor data. In an embodiment, both steps 450 and 460 can be executed in effort to prevent mis-adaptation.

At step 450, upon detection of a non-stationary event, an adaptation parameter may be modified. In particular, the LMS algorithm's step size may be reduced. The LMS algorithm's step-size controls the rate of adaptation. A smaller step-size slows the adaptation of the controllable filters 318 based on the acceleration and microphone sensor inputs. In one or more embodiments, the signal analysis controller 362 may inform the LMS controller 320 when a non-stationary event is detected so that they LMS controller may reduce the step size of its adaptation algorithm for the duration of the frame or of the nonstationary event. Reducing the step size for the duration of this frame may result in one or more of the controllable filters 318 changing less than they otherwise would have due to the presence of these non-stationary inputs. During this frame, the controllable filters that do not receive noise signal X(n) containing a nonstationary event may use an unmodified step size. In certain embodiments, adaptation of one or more controllable filters may be paused altogether by reducing the step size to zero for the duration of the frame, or by other techniques known to those of ordinary skill in the art.

In an alternative embodiment at step 460, sensor signal itself may be modified to mask the non-stationary event and prevent mis-adaption based on transient, non-stationary events. One technique may be to simply deactivate or mute RNC for the duration of the current DSP frame, resulting in the lack of anti-noise output signals Y(n) to some or all the speakers 324 in the RNC system 300. In certain embodiments, it may be possible to mute certain speakers that have medium to high amplitude controllable filters 318 for the particular noise signal X(n).

Because RNC systems typically have multiple feedforward vibration sensors, there are response options that are not available to simpler ANC systems, such as those employed in headphones. For example, if the frame containing the non-stationary event is simply zeroed, then no anti-noise related to this impulsive event will be radiated into the passenger cabin. Likewise, if this were an ANC headphone, then no anti-noise at all would be present during that frame. This may lead to an undesirable impression that ANC momentarily turned off (for the duration of that frame) and then resumed after the frame. The sudden discontinuity at the beginning or end of the DSP frame could also create the impression of undesirable pops and clicks coming from the speaker. Methods of temporal smoothing known to those skilled in the art of DSP may be applied to the samples at the start and the end of the current frame of data to prevent this. Alternately, smoothing or changes to the sample values just preceding or just following the current DSP frame can be made to prevent the audible pops and clicks. It is possible to replace the current frame of data with a signal that has near zero amplitude to eliminate or reduce audible pops and clocks at the beginning and/or end of the frame. In an embodiment, the data in the current frame can be replaced by samples that contain the averaged values of one or more previous frames that also eliminate or reduce audible pops and clicks.

The RNC system 300 may not exhibit this same undesirable behavior if a current frame of the feed-forward noise signal from one vibration sensor is zeroed. This is because the anti-noise radiated from each speaker 324 is made up of signals from multiple vibration sensor outputs. For instance, in an RNC system that employs 6 dual-axis accelerometers or 4 triaxial accelerometers, there will be 12 accelerometer output X(n) signals. In the case of 6 dual-axis accelerometers, zeroing the current frame containing parameters indicative of a nonstationary event would result in the reduction accelerometer signals used in creating the total anti-noise radiated from a particular speaker from 12 to 10. Thus, this may result in the decrease in anti-noise amplitude of 1.5 dB (i.e., 10/12), as compared to the complete muting of anti-noise to the speaker or to all the speakers for the duration of the frame.

In certain embodiments, more sophisticated solutions are possible, wherein only during the duration of the nonstationary event is the acceleration signal zeroed. This may further shorten the duration of the reduced anti-noise, which, in turn, may further mask the nonstationary event. Other techniques are possible, such as repeating the last frame of the output noise signal from the vibration sensor, rather than zeroing it. In various embodiments, any aforementioned mitigation technique, or combinations of techniques, may be accompanied by a reduced playback level during all or a portion of the current frame. This may be accomplished by reducing any, or combinations of any, W(z) filter amplitude, or by additional attenuation blocks (not shown) that reduce the level of one or more X'(n) or Y(n).

In the event that the non-stationary event is not totally eliminated in the adjusted noise signal X'(n) and/or the adjusted error signal e'(n), an additional measure can be undertaken to expedite re-adaptation to improve RNC performance on the surrounding pavement more quickly. In an embodiment, the step size can be increased for the one or more adjustable W-filters whose adjusted noise signal X'(n) contained a non-stationary event. The duration of this step size increase can be for one or more frames, or until the system has re-adapted to restore the pre-nonstationary event noise cancelling performance. In an embodiment, leakage can be increased for a duration of one or more frames in an effort more quickly to reduce the effect of the mis-adaptation on the W-filters.

In the foregoing specification, the inventive subject matter has been described with reference to specific exemplary embodiments. Various modifications and changes may be made, however, without departing from the scope of the inventive subject matter as set forth in the claims. The specification and figures are illustrative, rather than restrictive, and modifications are intended to be included within the scope of the inventive subject matter. Accordingly, the scope of the inventive subject matter should be determined by the claims and their legal equivalents rather than by merely the examples described.

For example, the steps recited in any method or process claims may be executed in any order and are not limited to the specific order presented in the claims. Equations may be implemented with a filter to minimize effects of signal noises. Additionally, the components and/or elements recited in any apparatus claims may be assembled or otherwise operationally configured in a variety of permutations and are accordingly not limited to the specific configuration recited in the claims.

Those of ordinary skill in the art understand that functionally equivalent processing steps can be undertaken in either the time or frequency domain. Accordingly, though not explicitly stated for each signal processing block in the figures, the signal processing may occur in either the time domain, the frequency domain, or a combination thereof. Moreover, though various processing steps are explained in the typical terms of digital signal processing, equivalent steps may be performed using analog signal processing without departing from the scope of the present disclosure.

Benefits, advantages and solutions to problems have been described above with regard to particular embodiments. However, any benefit, advantage, solution to problems or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the inventive subject matter, in addition to those not specifically recited, may be varied or otherwise particularly adapted to specific environments, manufacturing specifications, design parameters or other operating requirements without departing from the general principles of the same.

What is claimed is:

1. A method for preventing mis-adaptation in a feed-forward road noise cancellation (RNC) system, the method comprising:

adjusting an adaptive transfer characteristic of a controllable filter based on a noise signal received from a vibration sensor, an error signal received from a microphone located in a cabin of a vehicle, and an adaptation parameter;

generating an anti-noise signal based in part on the adaptive transfer characteristic, the anti-noise signal to be radiated by a speaker as anti-noise within the cabin of the vehicle;

detecting a non-stationary event based on signal parameters sampled from a frame of the noise signal; and modifying the noise signal, in response to detecting the non-stationary event, to obtain an adjusted noise signal, wherein the adaptive transfer characteristic of the controllable filter is adjusted based in part on the adjusted noise signal.

2. The method of claim 1, wherein the noise signal is modified, in response to detecting the non-stationary event, for at least the duration of the frame.

3. The method of claim 1, wherein modifying the noise signal to obtain the adjusted noise signal includes replacing the frame containing signal parameters indicative of the non-stationary event with a signal containing a zero amplitude.

4. The method of claim 1, wherein modifying the noise signal to obtain the adjusted noise signal includes replacing the frame containing signal parameters indicative of the non-stationary event with a signal containing a near zero amplitude.

5. The method of claim 1, wherein modifying the noise signal to obtain the adjusted noise signal includes replacing the frame containing signal parameters indicative of the non-stationary event with a previous frame from the noise signal.

6. The method of claim 1, wherein modifying the noise signal to obtain the adjusted noise signal includes replacing the frame containing signal parameters indicative of the non-stationary event with samples containing averaged values of one or more previous frames.

7. The method of claim 1, wherein detecting a non-stationary event based on signal parameters sampled from a frame of the noise signal comprises:

comparing at least one signal parameter of a current frame of the noise signal to a threshold; and detecting the non-stationary event when the at least one signal parameter exceeds the threshold.

8. The method of claim 7, wherein the signal parameter is a peak amplitude of the noise signal sampled in the frame.

9. The method of claim 7, wherein the signal parameter is an energy value of each frame.

10. The method of claim 7, wherein the threshold is a predetermined static threshold programmed for the RNC system.

11. The method of claim 7, wherein the threshold is a dynamic threshold computed from a statistical analysis of the at least one signal parameter in one or more preceding frames of the noise signal.

12. A road noise cancellation (RNC) system comprising:

a vibration sensor adapted to generate a noise signal on at least one output channel in response to an input;

a controllable filter adapted to generate an anti-noise signal based in part on an adaptive transfer characteristic, the anti-noise signal to be radiated by a speaker as anti-noise within a cabin of a vehicle;

an adaptive filter controller, including a processor and memory, programmed to control the adaptive transfer characteristic of the controllable filter based on the noise signal received from the vibration sensor, an error signal received from a microphone located in the cabin of the vehicle, and an adaptation parameter; and a signal analysis controller, including a processor and memory, programmed to:

detect a non-stationary event based on parameters sampled front a current frame of the error signal; and modify the error signal, in response to detecting the non-stationary event, to obtain an adjusted error signal, wherein the adaptive transfer characteristic of the controllable filter is controlled based in part on the adjusted error signal.

13. The RNC system of claim 12, wherein error signal is modified to obtain the adjusted error signal by replacing the frame containing signal parameters indicative of the non-stationary event with a signal containing a zero or near zero amplitude.

14. The RNC system of claim 12, wherein error signal is modified to obtain the adjusted error signal by replacing the frame containing signal parameters indicative of the non-stationary event with a previous frame from the error signal.

15. The RNC system of claim 12, wherein error signal is modified to obtain the adjusted error signal by replacing the frame containing signal parameters indicative of the non-stationary event with samples containing averaged values of one or more previous frames of the error signal.

16. The RNC system of claim 12, wherein the signal analysis controller is further programmed to:

detect the non-stationary event based on parameters sampled from a current frame of the noise signal; and modify the noise signal, in response to detecting the non-stationary event, to obtain an adjusted noise signal, wherein the adaptive transfer characteristic of the controllable filter is controlled based in part on the adjusted noise signal.

17. The RNC system of claim 12, wherein the signal analysis controller is programmed to detect a non-stationary event based on parameters sampled from a current frame of the error signal by comparing at least one signal parameter of a current frame for each error signal to a threshold.

18. A computer-program product embodied in a non-transitory computer readable medium that is programmed for road noise cancellation (RNC), the computer-program product comprising instructions for:

receiving noise signals from at least one vibration sensor;

detecting a non-stationary event based on signal parameters sampled from a frame of at least one noise signal;

modifying the at least one noise signal for a duration of the frame to obtain at least one adjusted noise signal in response to detecting the non-stationary event; and generating an anti-noise signal to be radiated by a speaker as anti-noise within a cabin of a vehicle based on the adjusted noise signal.

19. The computer-program product of claim 18, wherein the at least one noise signal is modified to obtain the at least one adjusted noise signal by zeroing the frame containing parameters indicative of the non-stationary event.

20. The computer-program product of claim 18, wherein the at least one noise signal is modified to obtain the at least one adjusted noise signal by replacing the frame containing parameters indicative of the non-stationary event with a previous frame from the at least one noise signal.

* * * * *